US009549622B2

(12) United States Patent
Leahy et al.

(10) Patent No.: US 9,549,622 B2
(45) Date of Patent: Jan. 24, 2017

(54) SHELF DIVIDER SYSTEM

(75) Inventors: John Leahy, Carrum Downs (AU); John Oretti, Doncaster (AU)

(73) Assignee: CHECKMATE INTERNATIONAL PTY LTD., Carrum Downs, Victoria (AU)

( * ) Notice: Subject to any disclaimer, the term of this patent is extended or adjusted under 35 U.S.C. 154(b) by 324 days.

(21) Appl. No.: 13/881,779

(22) PCT Filed: Oct. 26, 2011

(86) PCT No.: PCT/AU2011/001363
§ 371 (c)(1),
(2), (4) Date: Apr. 26, 2013

(87) PCT Pub. No.: WO2012/054971
PCT Pub. Date: May 3, 2012

(65) Prior Publication Data

US 2013/0213916 A1 Aug. 22, 2013

(30) Foreign Application Priority Data

Oct. 26, 2010 (AU) ..... 2010904776

(51) Int. Cl.
*A47F 1/12* (2006.01)
*A47F 5/00* (2006.01)
*A47F 1/04* (2006.01)

(52) U.S. Cl.
CPC . *A47F 1/04* (2013.01); *A47F 1/12* (2013.01); *A47F 5/005* (2013.01); *Y10T 428/2457* (2015.01)

(58) Field of Classification Search
CPC ..... A47F 1/04; A47F 1/12; A47F 5/005
(Continued)

(56) References Cited

U.S. PATENT DOCUMENTS 2,845,188 A * 7/1958 Rosenquist et al. ..... 211/184
2,885,091 A * 5/1959 Van Pelt ..... 211/184
(Continued)

FOREIGN PATENT DOCUMENTS

CA 2480957 A1 * 10/2003
EP 1714591 A1 * 10/2006
WO WO 0141603 A1 * 6/2001

OTHER PUBLICATIONS

International Search Report and Written Opinion dated Feb. 29, 2012 for Application No. PCT/AU2011/001363.

*Primary Examiner* — Stanton L Krycinski
(74) *Attorney, Agent, or Firm* — Frost Brown Todd LLC

(57) ABSTRACT

A shelf divider system that includes a shelf base (12) defining a support for multiple products, which base has a front (16) and a rear (18) and multiple parallel elongate slots (50) in the base. The slots extend in a direction from front to rear in multiple sets (53) of at least two aligned slots. An upstanding transversely extending front stop (26) mounted to the base at the front has an upper edge (31) and at or adjacent the upper edge respective seats (46) associated with the sets of at least two aligned slots. A plurality of dividers (28) each have a bottom edge (36) with a more rearward rearwardly extending protrusion (42) and a more forward depending tab means (48), and a front edge (32) with an upper forwardly extending protrusion (44), whereby each divider is selectively releasably engageable with any of the sets of at least two aligned slots by locating the rearwardly extending protrusion under a rear edge of a rear slot and pivoting the divider downwardly to locate the tab means in a front slot and the forwardly extending protrusion in an associated seat on the front stop, whereupon the divider is not disengagable except by reversing the pivoting action.

18 Claims, 10 Drawing Sheets

(58) Field of Classification Search
USPC ..... 211/184
See application file for complete search history.

(56) References Cited

U.S. PATENT DOCUMENTS

| | | | | | |
|---|---|---|---|---|---|
| 2,905,336 | A | * | 9/1959 | Higberg | 211/184 |
| 2,915,193 | A | * | 12/1959 | Bromberg | 108/61 |
| 3,160,282 | A | * | 12/1964 | Gunn | 211/184 |
| 3,269,558 | A | * | 8/1966 | Hess | 211/184 |
| 4,757,915 | A | * | 7/1988 | Albright et al. | 221/75 |
| 4,768,661 | A | * | 9/1988 | Pfeifer | 211/184 |
| 4,858,774 | A | * | 8/1989 | Winter et al. | 211/184 |
| 5,134,942 | A | | 8/1992 | Turnwald | |
| 5,156,280 | A | * | 10/1992 | Joist | 211/41.17 |
| 5,464,103 | A | * | 11/1995 | O'Brien | 211/133.3 |
| 5,673,801 | A | | 10/1997 | Markson | |
| 5,971,173 | A | * | 10/1999 | Valiulis et al. | 211/184 |
| 6,082,557 | A | * | 7/2000 | Leahy | 211/59.3 |
| 6,129,218 | A | * | 10/2000 | Henry et al. | 211/59.3 |
| 6,523,703 | B1 | * | 2/2003 | Robertson | 211/59.3 |
| 6,533,131 | B2 | * | 3/2003 | Bada | 211/59.2 |
| 6,695,152 | B1 | * | 2/2004 | Fabrizio | A47F 1/12 211/175 |
| 6,874,646 | B2 | * | 4/2005 | Jay | 211/59.2 |
| 6,962,260 | B2 | * | 11/2005 | Jay et al. | 211/59.2 |
| 7,083,054 | B2 | * | 8/2006 | Squitieri | 211/59.2 |
| 8,104,630 | B2 | * | 1/2012 | Schneider | 211/184 |
| 8,172,094 | B2 | * | 5/2012 | Meyer et al. | 211/59.3 |
| 2003/0010737 | A1 | * | 1/2003 | Lee | 211/184 |
| 2005/0133471 | A1 | * | 6/2005 | Squitieri | 211/59.2 |
| 2005/0150847 | A1 | * | 7/2005 | Hawkinson | 211/59.2 |
| 2007/0029270 | A1 | * | 2/2007 | Hawkinson | 211/59.3 |
| 2010/0252519 | A1 | | 10/2010 | Hanners et al. | |

* cited by examiner

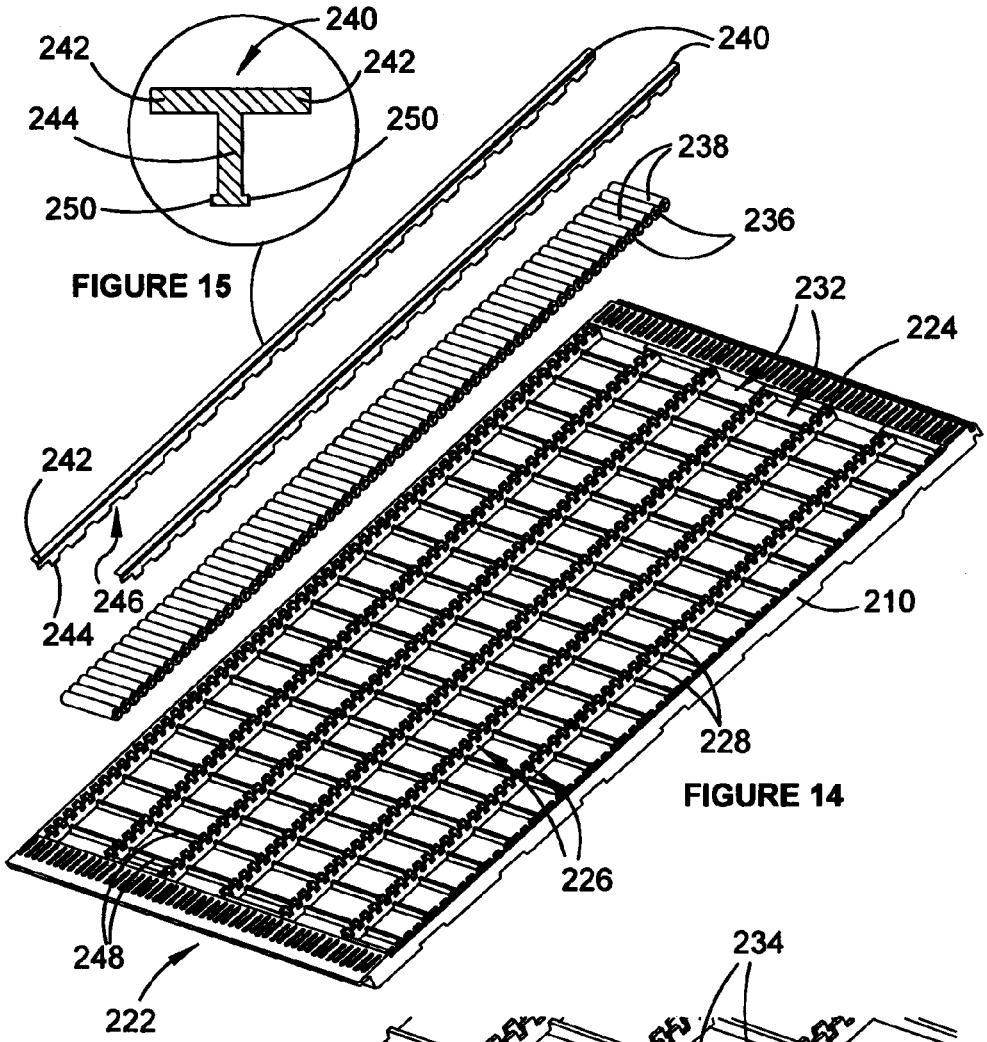
FIGURE 15
FIGURE 14
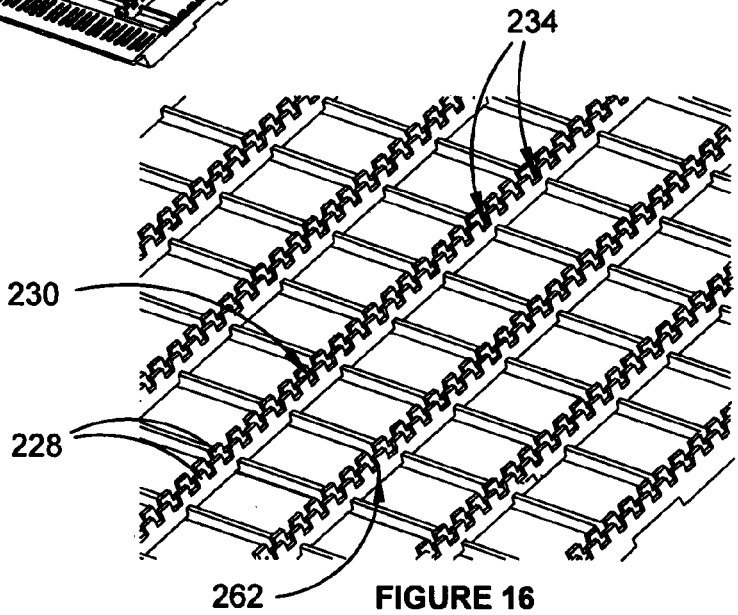
FIGURE 16

SHELF DIVIDER SYSTEM

FIELD OF THE INVENTION

The present invention relates generally to shelving systems for displaying products in a retail environment, and to gravity feed systems, where the shelves are downwardly angled to convey items to the front of the shelf. The shelving systems generally include dividers, which are fitted to the shelves to organise products into discrete straight rows. One aspect of the invention relates to a shelf divider system, which in one form includes a slip mat, also known as a glide, having a multiplicity of spaced parallel ribs aligned front to rear of the mat to provide a gliding or slip surface down which items can slide under gravity. In a second aspect, the invention relates to roller mats.

BACKGROUND OF THE INVENTION

A wide variety of devices has been developed to display and merchandise products. Prior art includes flat shelves with separators or dividers to present products in straight rows for better shelf management. U.S. Pat. No. 5,803,276 discloses a divider with lateral stabiliser feet that is extendable longitudinally for deeper shelves. Further alternatives have included front and rear tracks attached to the shelf to which longitudinal tracks are attached to move product forward as disclosed in International patent publication WO2007071024.

These arrangements were further improved by angling a flat shelf fitted with dividers to create a broad genus of gravity feed products. However, such flat shelf surfaces had a poor co-efficient of friction and products did not slide effectively.

A further advance, as disclosed in U.S. design Pat. 275058, involved glides with slip surfaces. They facilitated the gravity feed but had the disadvantage of having a fixed footprint. This was further improved by gravity feed glides that had adjustable front and rear fitments to accommodate products of varying sizes, as in U.S. Pat. No. 7,182,209.

An alternative showcase involved the combining of the glide and the divider into one separator device as disclosed in the applicant's earlier U.S. Pat. No. 6,082,557. Here the upright device has two lateral base protrusions with fine longitudinal ribs on their upper surfaces to gravity feed product. Channels to gravity feed items are created when two such devices are placed side by side on an open shelf frame. Ribs under the front and rear engage in a selected pair of slots arranged in two rows at the front and rear of the shelf frame. The ability to gravity feed is improved but product has to be taken off the shelf to re-configure the shelf.

Typically, divider devices include front lateral flanges that provide stops at the shelf front to prevent forward movement of items off the shelf. Again, product has to be taken off the shelf to reconfigure the shelf. U.S. Pat. No. 5,971,173 discloses an alternative configuration in which a discrete stop extends across the front of the shelf and each divider clips to the stop.

A further advance involved the development of an integral slip mat to which independent dividers are fitted. This mat has a crosshatch of interlocking lateral and transverse ribs into which protrusions on the base of the divider engage. A known system includes a mat that can be adjusted to accommodate a wide variety of shelf sizes by first piercing the top membrane of the mat and then snapping off the bottom. The system also has dividers with weakened sections to allow them to be shortened for shallower shelves.

However, these dividers are difficult to align in the longitudinal channels in the mat, and when engaged in the channels are difficult to disengage, rendering realignment of products on the shelf slow and time consuming. Systems of this general kind are disclosed, for example, in U.S. Pat. Nos. 6,874,846 and 6,982,260.

It would be advantageous if a system could be provided that permitted an operator to quickly and easily disengage, re-engage and align dividers without any need to clear product from the shelf.

Within the genus of gravity feed systems it is known to move product forward by means of rollers. Disclosures include U.S. Pat. Nos. 6,089,385, 6,409,026 and 6,497,326. Prior art for both retail and industrial application has included single roller tracks which when aligned in parallel can bias product from the rear to the front of a shelf. Such systems have the disadvantage that they are complex and costly to manufacture, and are designed to be fitted to specialised shelving.

Therefore, it is an object of a second aspect of the invention to provide a roller assembly that at least in part improves on prior art systems.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

In a first aspect, the invention provides a shelf divider system that includes a shelf base defining a support for multiple products, which base has a front and a rear and multiple parallel elongate slots in the base. The slots extend in a direction from front to rear in multiple sets of at least two aligned slots. An upstanding transversely extending front stop mounted to the base at the front has an upper edge and at or adjacent the upper edge respective seats associated with the sets of at least two aligned slots. A plurality of dividers each have a bottom edge with a more rearward rearwardly extending protrusion and a more forward depending tab means, and a front edge with an upper forwardly extending protrusion, whereby each divider is selectively releasably engageable with any of the sets of at least two aligned slots by locating the rearwardly extending protrusion under a rear edge of a rear slot and pivoting the divider downwardly to locate the tab means in a front slot and the forwardly extending protrusion in an associated seat on the front stop, whereupon the divider is not disengagable except by reversing the pivoting action.

In an embodiment the shelf base is an integral slip mat having a multiplicity of spaced parallel ribs aligned front to rear to provide a slip surface along which products may slide, which ribs define the elongate slots between them.

The integral slip mat may further have plural support beams below the slip surface extending transversely to and being integrally joined to the ribs, whereby to define the multiple sets of at least two aligned slots. The rearwardly extending protrusion of each divider preferably locates under a shoulder of a first support beam of the plural support beams.

The integral slip mat may further include at least one transversely extending fracture line of reduced thickness segments adjacent respective said first support beams. The dividers may then include dividers of different lengths to accommodate different depths of the slip mat before and after fracture of the slip mat along the or each fracture line.

The tab means preferably includes at least one slotted tab and the Integral slip mat may then include formations on a second support beam of the plural support beams that deepen the slots adjacent the second support beam for firmly seating a slotted tab pressed onto the second support beam.

The slip mat may have plural second support beams to match different slotted tab locations on dividers of different lengths.

The upstanding transversely extending front stop is preferably mounted to the slip mat by releasable slidable engagement with an outstanding integral rail at the front of the slip mat.

The seats on the upstanding transversely extending front stop may comprise respective notches in the upper edge of the stop.

Preferably, the divider is not slidable from front to rear or vice-versa when the tab means is located in the front slot and the forwardly extending protrusion is located in its associated seat on the front stop.

The forwardly extending protrusions advantageously each have a downturned or return portion for firmly locating the upstanding transversely extending stop between the downturned or return portion and the front edge of the divider.

In its first aspect the invention further provides a shelving system including a shelf divider system as aforedescribed. In one embodiment, the shelving system may include a shelf that comprises the shelf base of the assembly. In another embodiment the shelving system may include a shelf for receiving the shelf base of the assembly, in which case the shelf base is an integral slip mat having a multiplicity of spaced parallel ribs aligned front to rear to provide a slip surface along which products may slide, which ribs define elongate slots between them.

In its first aspect, the invention also provides a divider for a shelving system having a bottom edge with a more rearward rearwardly extending protrusion and a more forward depending tab means, and a front edge with an upper forwardly extending protrusion. Each divider is selectively releasably engageable with a set of at least two aligned slots in a shelf base by locating the rearwardly extending protrusion under a rear edge of a rear slot and pivoting the divider downwardly to locate the tab means in a front slot and the forwardly extending protrusion in an associated seat on an upper edge of an upstanding transversely extending stop mounted to the shelf base at its front.

The invention still further provides, in its first aspect, an integral slip mat that includes a multiplicity of spaced parallel ribs aligned front to rear of the mat to provide a slip surface along which products may slide. Plural support beams below the slip surface extend transversely to and are integrally joined to the ribs, whereby to define multiple elongate slots between the ribs arranged in multiple sets of at least two aligned slots. At least one transversely extending fracture line of reduced thickness segments is provided adjacent respective first support beams of the plural support beams, and formations on at least one second support beam of the plural support beams deepen the slots adjacent the second support beam for firmly seating a slotted tab of a divider pressed onto the second support beam.

Preferably only a single pivoting downward motion required to engage the divider in position.

Preferably the front tab includes two small lateral protrusions, which lock underneath the rails when pushed down to prevent upward movement of the divider. The downwardly projecting tabs preferably have straight front and rear edges, i.e. do not include a hooked portion, such that they can be lowered straight down into the slots without requiring forward or backward sliding to engage.

Preferably, one or more slip mats can be joined together front to rear to create a deeper shelf. As the depth of the slip mats can be shortened, different depths of slip mats can be joined together to create a variety of different depth assemblies. The fracture lines may be located such that predetermined depths of slip mats can be provided, which correspond to different dividers of standard lengths. Such standard depths of slip mat are typically: 280 mm, 330 mm, 380 mm, 430 mm, 480 mm and 560 mm. Advantageously the fracture lines are spaced at 50 mm increments from the front of the slip mat.

At least the lower portion of the rear edge of the divider is preferably forwardly sloped, such that the rearward projection can be engaged under the rearmost support beam with the front of the divider raised upwardly without the rear wall of the supporting shelf interfering with the divider.

Advantageously, the slip mat assembly can be attached to the shelf by screws or other fasteners.

According to a second aspect, the invention is directed to a shelf assembly, including:

- a moulded mat for placement on a supporting shelf, the mat having a plurality of walls running from the front to the rear of the mat and defining a plurality of channels, the walls including spaced notches;
- a plurality of stub rollers having a stub at each end, the plurality of stub rollers positioned in the channels with the stubs engaged in the notches;
- a plurality of longitudinal locking members positioned over said walls to lock said stub rollers in said channels.

Each wall preferably two longitudinal members spaced apart to define a small gap there between. Advantageously, the locking members are T-shaped having two upper outwardly extending arms and a downwardly extending tab or tabs. The tab or tabs may engage in the gap between the two longitudinal members, with the upper arms extending over the longitudinal members to lock the stub rollers into the notches.

The downwardly extending tab or tabs on the locking members are preferably a plurality of tabs divided by slots. The moulded mat preferably includes a plurality of spaced support beams extending transversely to the walls. The slots on the locking members preferably align with the support beams. Advantageously, the tabs include lateral protrusions, or a flange, on either side, which lock underneath the walls on either side to prevent removal, such that the locking members are simply required to be pushed down into a locking position.

Advantageously, the notches in adjacent walls are offset.

Preferably, each mat includes at least six channels of rollers.

As used herein, except where the context requires otherwise the term "comprise" and variations of the term, such as "comprising", "comprises" and "comprised", are not intended to exclude other additives, components, integers or steps.

BRIEF DESCRIPTION OF THE DRAWINGS

The invention will now be further described, by way of example only, with reference to the accompanying drawings, in which:

FIG. 14 is an isometric partially exploded view of the shelving system shown in FIG. 12;

FIG. 15 is a fragmentary cross-sectional front view of a portion of FIG. 14; and FIG. 16 is a close up view of a section of FIG. 14.

DETAILED DESCRIPTION OF EMBODIMENTS OF THE INVENTION

Figure 1:
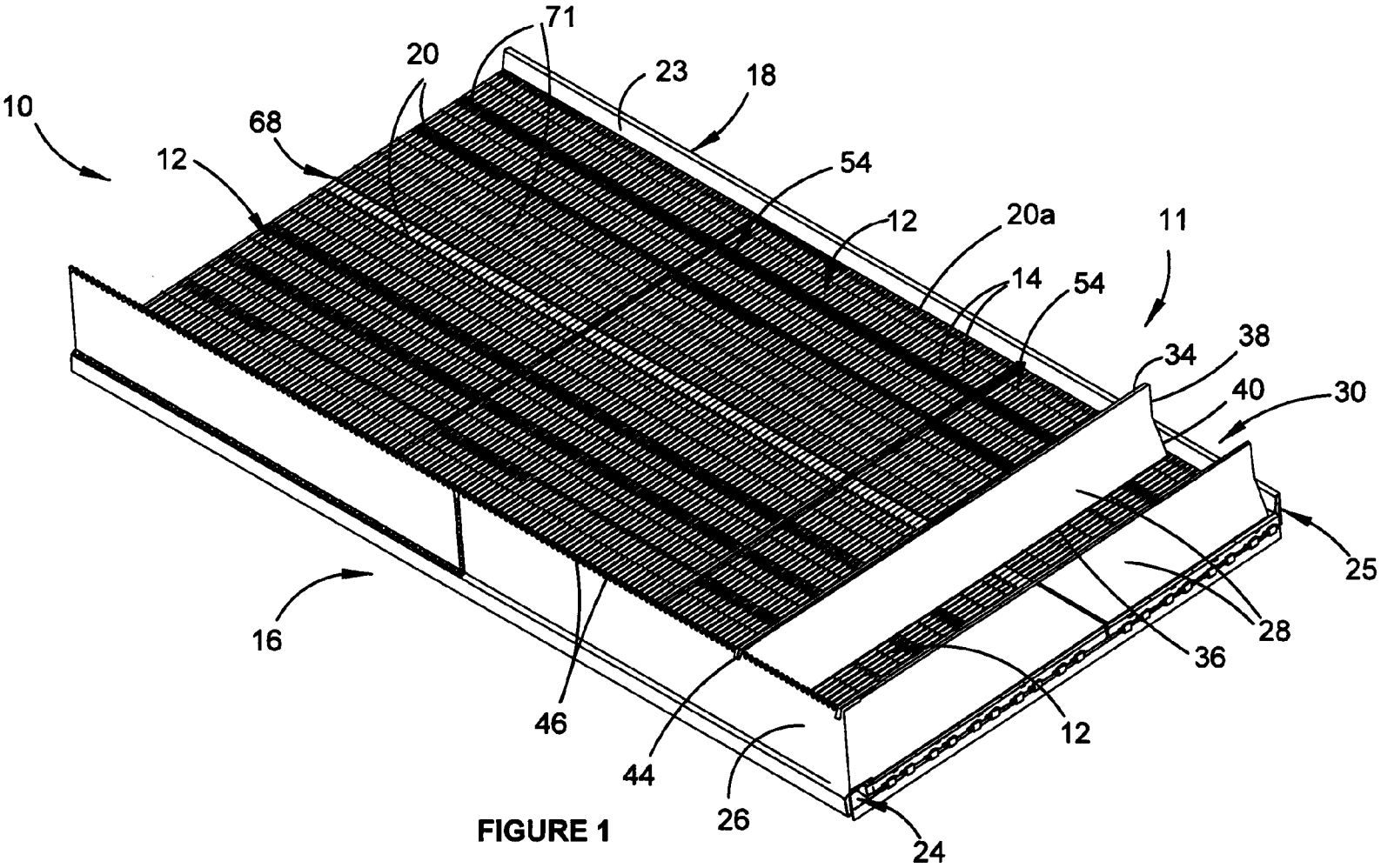
FIG. 1 is an isometric top view of a shelving system incorporating a shelf divider system that is an embodiment of the first aspect of the present invention.
Figure 2:
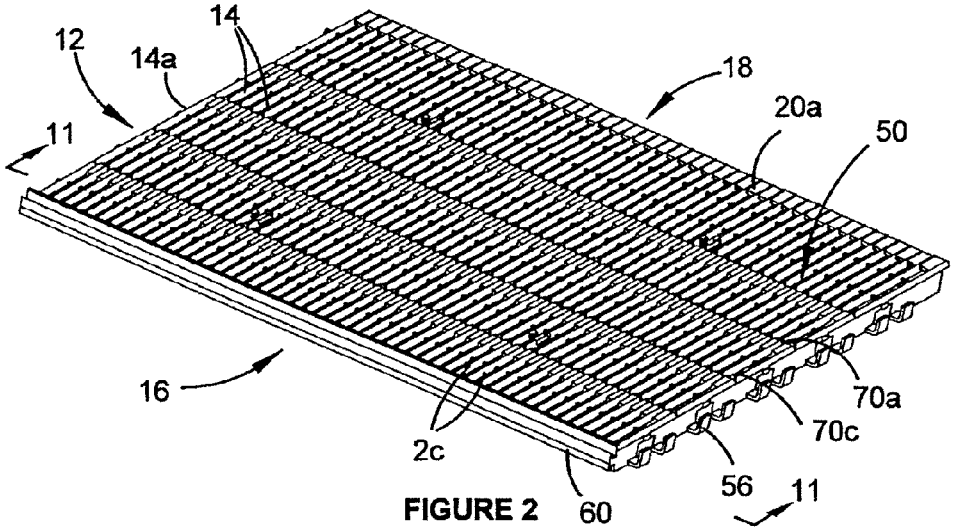
FIG. 2 is an isometric top front view of one of the slip mats shown in FIG. 1.
Figure 3:
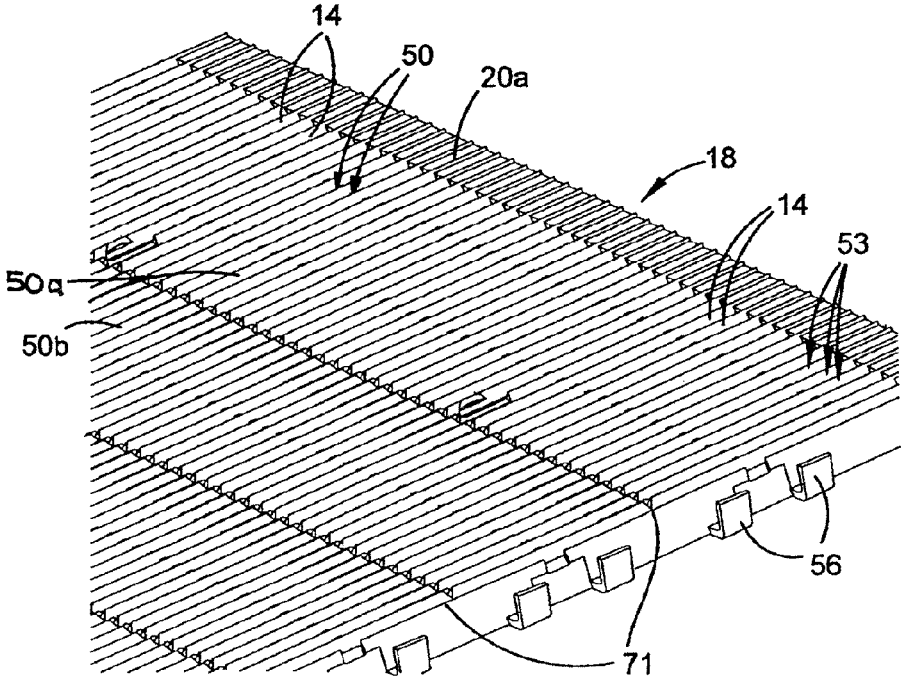
FIG. 3 is an enlargement of part of FIG. 2.
Figure 4:
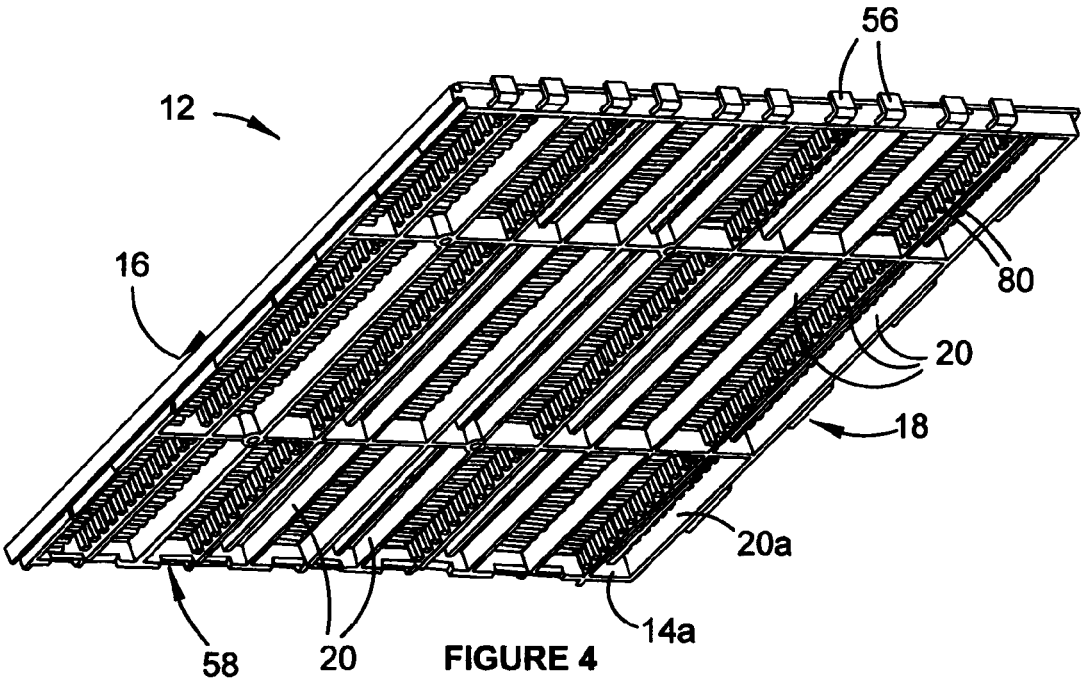
FIG. 4 is an underneath view of the slip mat.
Figure 5:
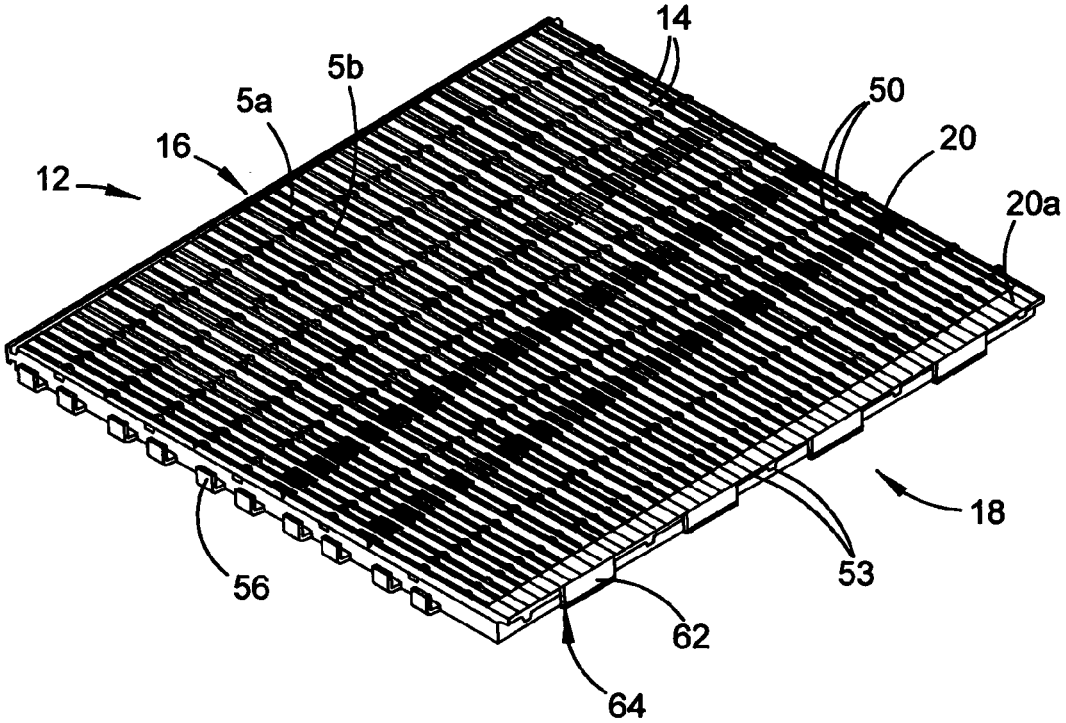
FIG. 5 is an isometric top rear view of the slip mat.

FIGS. 1 to 11 show a shelving system 10, which includes a flat tray shelf 22 fitted with a shelf divider system 11 according to an embodiment of the first aspect of the invention. Shelf divider system 11 includes an array of shelf bases in the form of integral slip mats 12 each having a plurality of spaced parallel ribs 14 from the front 16 to the rear 18 of the mat 12. Extending transversely, perpendicular to the ribs 14, are support beams 20 that are spaced along the depth of the mat 12. The support beams 20 are located underneath the ribs 14 and in effect hold the ribs above the surface of the supporting shelf 22.

The supporting shelf 22 is a gravity feed shelf, i.e. it is typically placed at a forward downward angle, so that items can easily slide to the front 16 of the shelving system. The ribs 14 therefore provide an upper slip surface of the shelf down which items placed thereon slide. The slip mat 12 slides into a channel 25 at the rear of the supporting shelf 22 to hold the slip mat 12 in place. The slip mat or mats can be fastened to the shelf 22 by screws or other fastening devices.

Ribs 14 define elongate slots 50 between the ribs, while support beams 20, which lie below the slip surface, divide slots 50 into multiple sets 53 of at least two (typically six or more) aligned slots 60*a*, 50*b*.

Shelf divider system 11 further includes an upstanding transversely extending front stop 26 mounted to slip mat 12 at its front to prevent items from falling off the front of the shelf, and a plurality of dividers 28 (two are illustrated in FIG. 1) that are selectively releasably engageable with the slip mat 12 to divider the shelf into channels 30 so that various items can be stacked next to each other on the shelf and remain in alignment. Stop 26 also provides a face for labeling or pricing, if required. Stop 26 (best seen in FIGS. 6 and 7) is generally L-shaped, having a base 27 and an upright transversely elongate wall 29 with a castellated upper edge 31 that defines a series of evenly spaced rectangular notches 46 associated with, and in alignment with, the sets 53 of aligned slots 50 in the mat. Base 27 has a rear edge 27*a* of C-configuration that slidably engages a T-rib 60 on the front of the slip mat 12 whereby to firmly mount the stop 26 to the mat.

Figure 6:
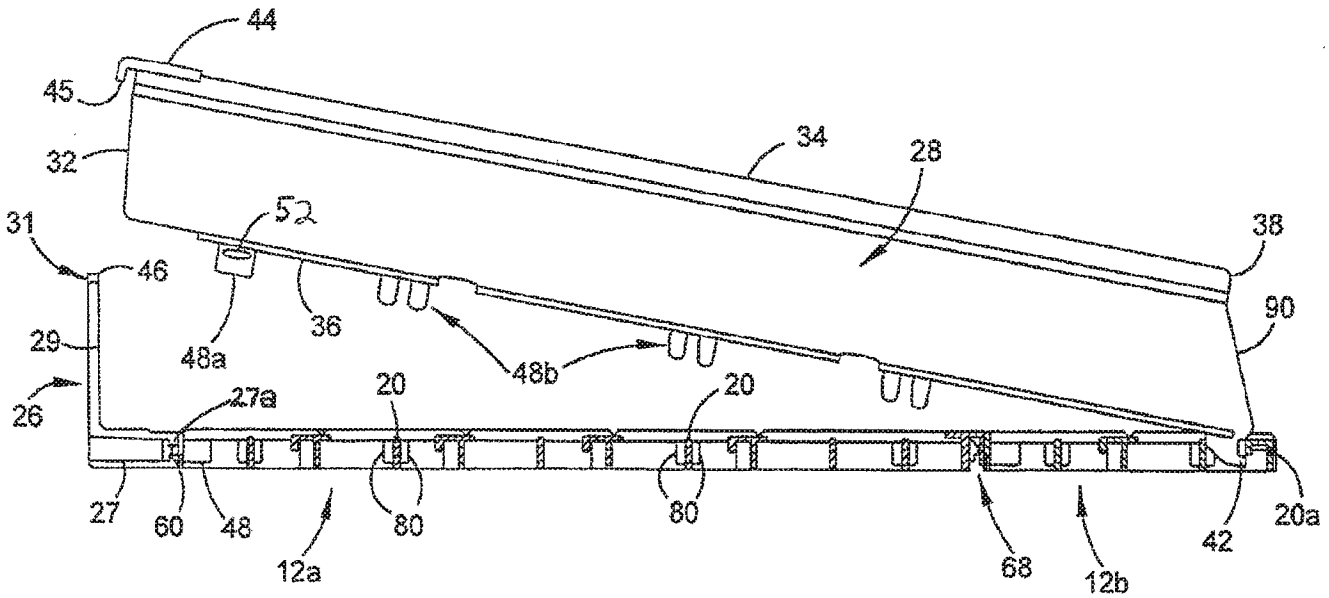
FIG. 6 is a front-to-rear cross-section depicting an intermediate stage in the installation of a divider on the slip mat.
Figure 7:
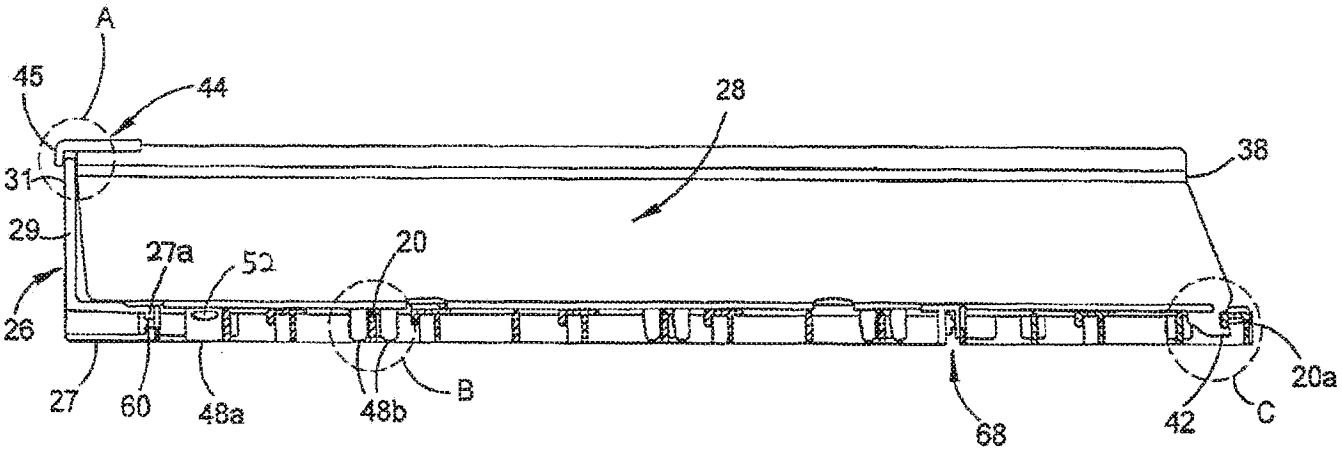
FIG. 7 is a view similar to FIG. 8 showing the divider fully installed.
Figure 10:
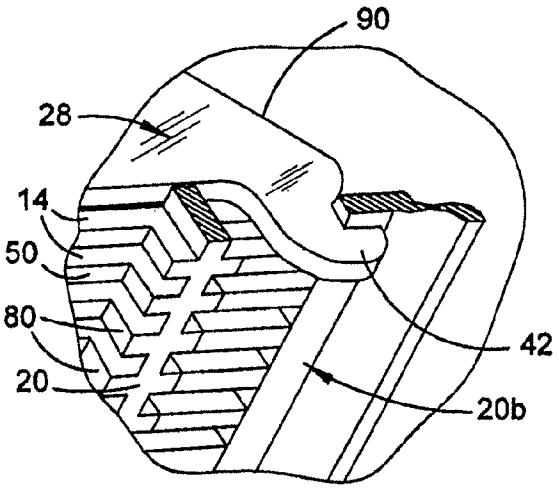
FIGS. 8, 9 and 10 are respective fragmentary isometric enlargements of regions A, B and C in FIG. 7.
Figure 8:
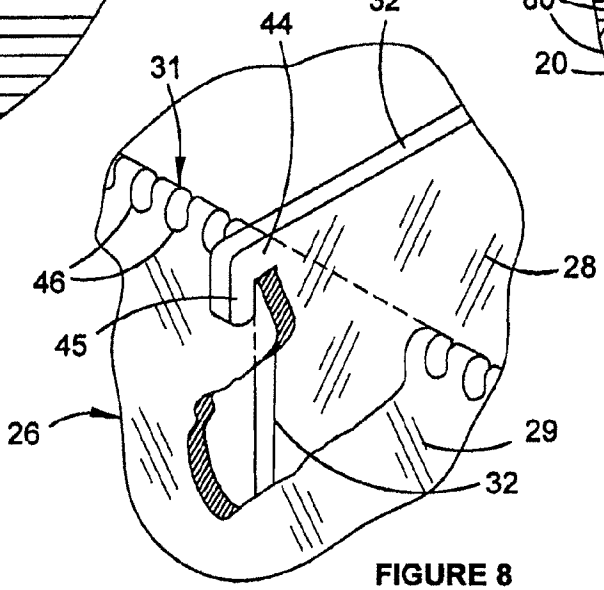
Figure 9:
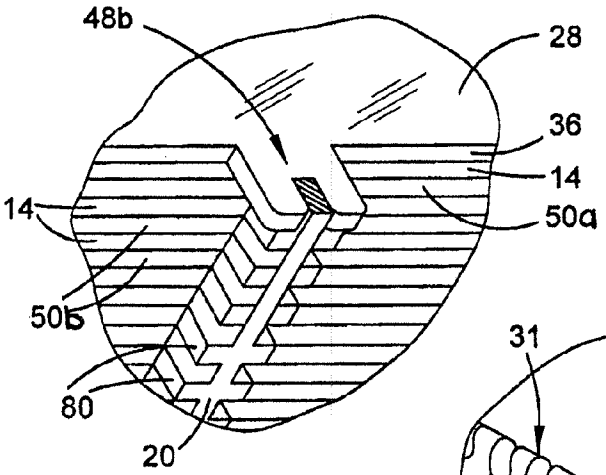
Figure 11:
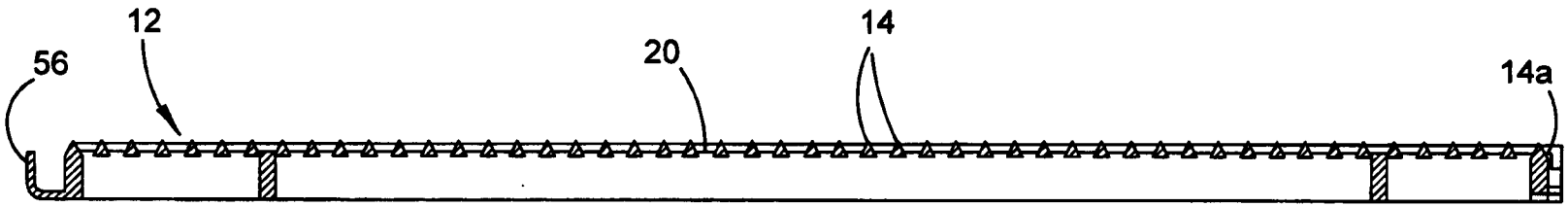
FIG. 11 is a cross-section on the line 11-11 in FIG. 2.
Figure 12:
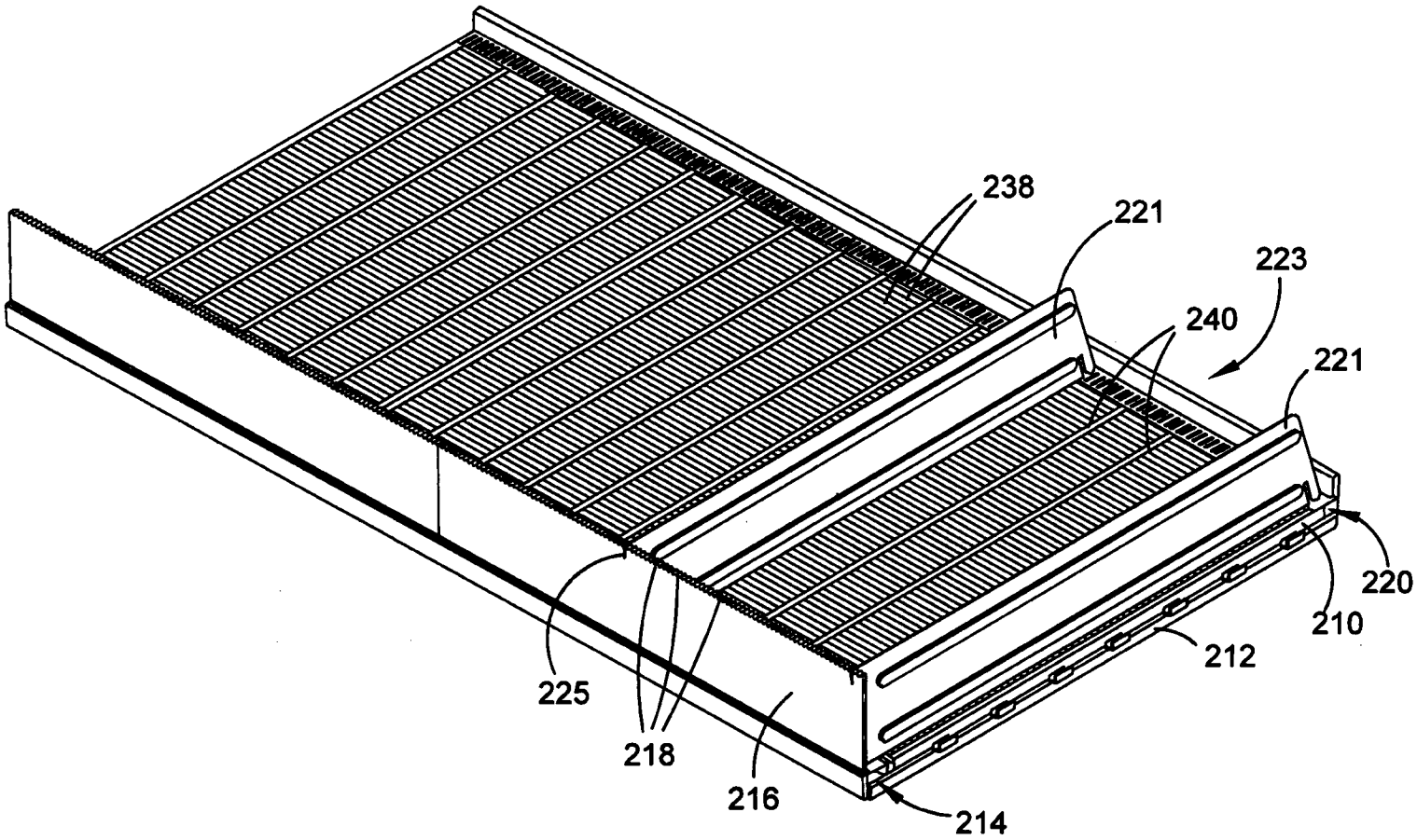
FIG. 12 is an isometric top view of a shelving system according to a second aspect of the present invention.
Figure 13:
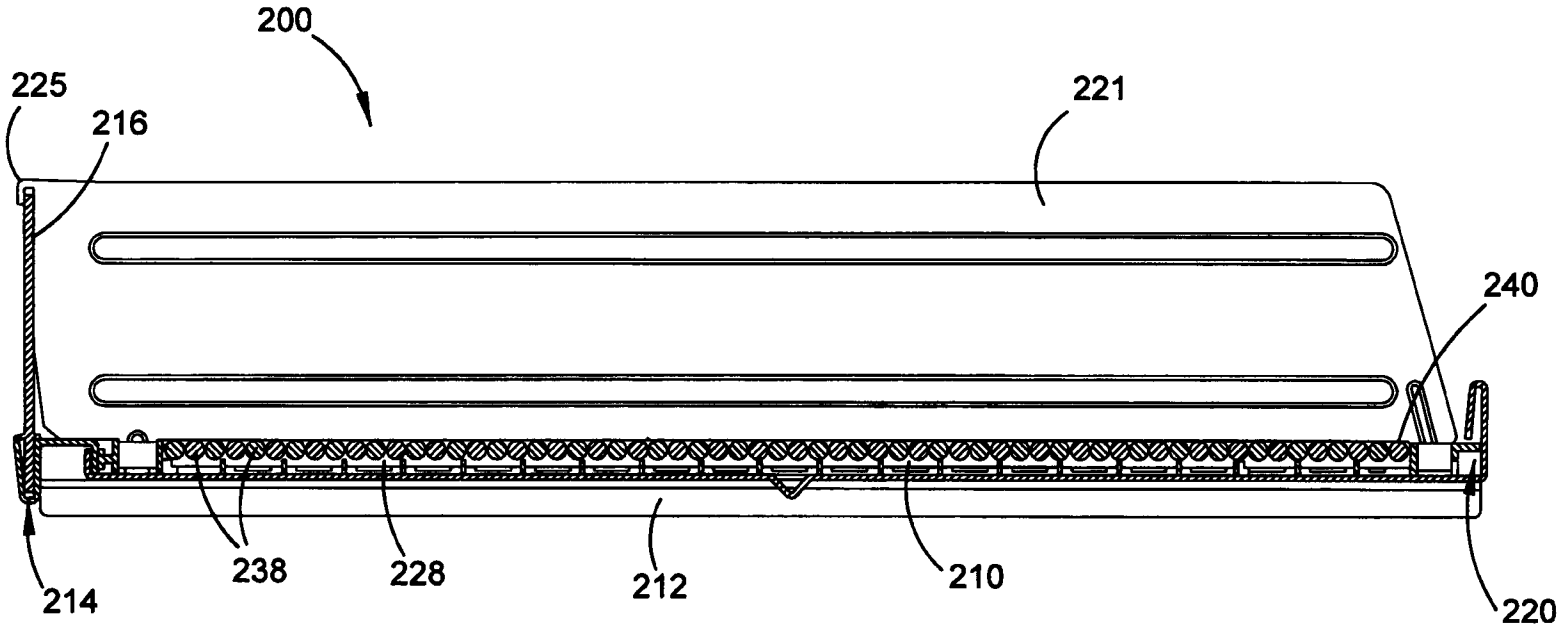
FIG. 13 is a front-to-rear cross-section of the shelving system of FIG. 12.

Each divider 28, best shown in FIGS. 6 and 7, is a flat, generally rectangular panel and includes a front generally straight vertical edge 32, an upper edge 34, a bottom edge 36 and a rear edge 38. The rear edge 38 includes a lower portion 40 that is forwardly sloped. At the rear of bottom edge 36 is a downwardly and rearwardly extending protrusion 42 that creates a hook. At the front, upper edge is another hook 44 that is a forwardly extending protrusion. The rear hook 42 engages underneath a rearmost support beam 20*a* of the slip mat, with the front hook 44 engaging in a notch 46 on the front stop 26, as shown in FIG. 1 and more clearly seen in FIGS. 7 and 8.

The bottom edge 38 of the divider 28 also includes a plurality of spaced downwardly projecting tabs 48 that sit within the slots 50 defined between the rails 14 and the support beams 20. Tabs 48 have straight front and rear edges so that they slot straight down into slots 50. In prior art dividers, each of these tabs would be hooked, such that the divider is slotted downwards held horizontally and then slid vertically backwards to engage the hooks under similar support beams. The tabs 48 in the present embodiment do not act to stop the divider from being lifted up, but simply act to prevent sideways bowing and movement of the divider when items are pushed against it. However, the forwardmost tab 48*a* may include two small lateral protrusions 52, which lock underneath the rails 14 on either side to assist in preventing upward movement of the divider, but a simple downward pivoting and pushing of the divider locks it in place without any sliding movement required.

In contrast to the downward movement and then rearward sliding of a typical divider of the prior art, the present invention requires the divider to be readied for insertion with the front edge 32 up and the rear edge 38 down. The rear hook 42 is inserted underneath the rearmost support beam 20*a* (the stage depicted in FIG. 8) and the front edge 32 is lowered down in a pivoting, scissor-like motion, with the tabs 48 slotting into the slots 50 as the front edge 32 is lowered. When fully lowered, the frontmost tab 48*a* slots in and the front hook 44 is automatically lined up with and seated into the correct corresponding notch 46 in the front 26. Each notch 46 is therefore a seat for a hook 44. This makes it easy for a single operator to quickly insert dividers 28 into the shelves from the front 18 of a shelving system 10. The sloped section 40 on the rear edge 38 of the divider 28 makes the insertion of the rear hook 42 easier, as the rear edge 38 does not abut against the rear wall 23 of the supporting shelf 22 during insertion. By having a single hook at the rear and a single hook at the front, the divider 28 is simple and easy to both install and remove for repositioning. Moreover, the dividers can be lifted and re-installed without any need to clear the shelf of product.

It will be seen in FIGS. 6 and 7 that tabs 48 are provided in two forms—a simple rectangular tab 48*a* at the front, and centrally slotted or twin tabs 48*b* further back. Slotted tabs 48*b* are positioned to engage and receive respective transverse support beams 20, as seen in FIG. 7. Moreover, these particular support beams include vertical rib-like formations 80 (FIGS. 4 and 9) that deepen the slots 50 adjacent the support beams for more firmly seating the slotted tabs 48*b*. There are then at least two subsets of support beams: those with trains of formations 80 and those defining an underlying shoulder 51 engaged by rear hooks 42: the latter arrangement is depicted in detail in FIG. 10.

It will be appreciated that the effect of the various locating engagements when the divider is in its installed position is that the divider is not disengageable for removal except by reversing the aforedescribed pivoting, scissor-like motion. Furthermore, the divider is not slidable in the front-to-rear direction or vice-versa when in its installed position. To further ensure this, forwardly extending protrusion 44 has a downturned or return portion 45 for firmly locating the upstanding transversely extending stop between the downturned or return portion 45 and the front edge 32 of the divider.

As can be seen from the Figures, a number of slip mats 12 can be placed next to each other to fill the width of the supporting shelf 22. In the embodiment shown in FIG. 1, three slip mats are placed next to each other to fill the supporting shelf 22. The join lines 54 can be seen between the adjacent slip mats 12. The joining of adjacent slip mats 12 is achieved by one side having upward hooks 56 that slot underneath an outermost rail 14*a* on the other side of the adjacent slip mat. The outermost rail 14*a* extends the full height of the slip mat, rather than just sitting on top of the support beams 20 as to the intermediate ribs 14, and includes cut out sections 58 (shown in FIG. 4) to accommodate the hooks 56.

A number of slip mats 12 can also be joined front 16 to rear 18. The rear 18 has a number of spaced downward tabs 62 that each create a channel 64 behind the tab. The tabs slot over the T-rib 60 on the front of the slip mat 12 positioned behind it, with the tab 62 slotting into the channel 66 behind rib 60 and the rib 60 slotting into the channels 64. In the embodiment shown in FIG. 1, two rows of slip mats 12 are shown, with the join line being shown by reference numeral 68. Therefore, the shelving system 10 shown in FIG. 1 includes a slip mat assembly made up from six individual slip mats 12, joined both side by side and front to back.

In the case where slip mats 12 are joined front to back, the rearmost support beam 20*a* that the rear hook 42 of the divider 28 engages is the rearmost support beam 20*a* of the rearmost slip mat 12. Dividers 28 of different lengths are therefore provided to correspond with the standard depth of supporting shelves available. Such standard depths of supporting shelves are 305 mm, 355 mm, 405 mm, 455 mm, 505 mm and 570 mm. A single slip mat 12 corresponding to a supporting shelf of depth 305 mm will have a depth of approximately 280 mm.

To avoid making slip mats in six different sizes, the slip mats 12 can be cut to shorter depths. Fracture lines 71, of reduced thickness segments such as notches 70 in ribs 12, are provided across each mat 12. The notches 70 are spaced along the ribs 14 at set positions and align with a support beam 20 located underneath the ribs 14. The notches 70 are either located directly in line with the rear edge of the support beam 20 as shown in FIG. 2*a*, or are across the support beam 20, but once the mate is cut along a fracture line the majority of the support beam 20 remains. The resultant lesser depth slip mat therefore has a successive rearmost support beam for engagement by a divider 28 of length corresponding to the subsequent shortened depth of the slip mat 12. Shorter depth slip mats 12 can then be joined to a standard depth front slip mat 12 to create a variety of standard dimensions to fit corresponding standard depth supporting shelves.

Because the notches 70 for cutting the slip mat 12 are aligned with support beams 20, when the slip mat is cut at any of the fracture lines 71, a rearmost support beam 20 will always remain that is positioned to align correctly with the rear of the supporting shelf to provide the required shoulder for engagement by the rearwardly extending hook 42 on the divider.

For a shelf of depth 606 mm, a slip mat would be created from a slip mat of 280 mm, with a slip mat of 205 mm joined to the rear 18, with 5 mm being the overlap in the join 68. A slip mat of 280 mm depth would include four fracture lines 71 of notches, with the first 71*a* being spaced 50 mm from the front 18 of the slip mat. The second line of notches 70*b* is spaced a further 50 mm, at 100 mm from front 16. The third line of notches 70*c* is spaced a further 50 mm, at 150 mm from front 16 and the fourth line of notches 70*d* is spaced a further 50 mm, at 200 mm from front 16. This fourth line of notches 70*d* is therefore spaced from the rear 18 of the slip mat by 80 mm.

Accordingly, for a supporting shelf of 305 mm, a single slip mat of depth 280 mm is used, with a divider of 300 mm. For a supporting shelf of 355 mm a slip mat of 280 mm is used with a second slip mat cut to 50 mm, creating a slip mat assembly of 330 mm, with a divider of 350 mm. Similarly, for a supporting shelf of depth 405 mm, a slip mat cut to 100 mm is joined to the rear of a 280 mm slip mat to create a slip mat assembly of 380 mm, with a divider of 400 mm. For a supporting shelf of depth 455 mm, a slip mat, cut to 150 mm is joined to the rear of a 280 mm slip mat to create a slip mat assembly of 430 mm, with a divider of 450 mm. Again, for a supporting shelf of depth 505 mm, a slip mat cut to 200 mm is joined to the rear of a 280 mm slip mat to create a slip mat assembly of 480 mm, with a divider of 500 mm. However, for a supporting shelf of depth 570 mm two full 280 mm slip mats are joined together to make a slip mat assembly of 560 mm, with a divider of 565 mm.

As the notches 70 for cutting the slip mats 12 are always located with a support beam 20, each of the cut lengths of slip mats joined to the rear of the front slip mat 12 will still provide the required rearmost support beam for engagement by the rearwardly extending projection 42. The embodiment shown in FIG. 7 has a front slip mat 12*a* of 280 mm depth with a second slip mat 12*b* joined to the rear. The second slip mat 12*b* is of 100 mm depth, with the divider being of 400 mm length to fit a supporting shelf 22 of 405 mm length or depth.

In an embodiment not shown, the shelf base is not a slip mat but a shelf, e.g. a metal shelf, from which are punched multiple sets of aligned slots for engagement by the dividers in a similar fashion to the interengagement depicted in FIGS. 6 and 7.

A second aspect of the invention is shown in FIGS. 12 to 16, which show a shelf assembly 200 of the roller gravity feed type. The assembly 200 includes at least one moulded mat 210 that is placed on a supporting shelf 212. The supporting shelf 212 has a front channel 214 for receiving a front upright member 216 that includes spaced notches 218. The supporting shelf 212 also includes a rear channel 220. A divider 221 is provided to define channels 223 into which items are stacked. The divider 221 includes a front hook 225 for engagement with the notches 218 in the front upright 216.

The moulded mat 210 has a front 222 and a rear 224, with the rear 224 of the mat 210 sitting in the rear channel 220 in the supporting shelf 212. The mat 210 has a plurality of spaced walls 226 running from the front 222 to the rear 224 of the mat. Between the walls 226 channels 232 are defined. Each wall includes two longitudinal members 228 spaced apart to define a small gap 230 there between. The longitudinal members 228 include spaced notches 234 for receiving the stubs 236 of stub rollers 238.

A line of stub rollers 238 are abutted against each other down the channels 232. The notches 234 in adjacent longitudinal members 228 are offset so that adjacent rollers are not aligned but offset also. This assists the items to roll down the mat.

Longitudinal locking members 240 are provided that are T-shaped in cross-section, as shown in FIG. 15. The locking members 240 have two upper outwardly extending arms 242 and a downwardly extending tab 244 with cut outs 248 to accommodate the support beams 248 on the mat that extend transversely to the walls 226. The locking members 240 slot over the walls 226, with the tab 244 slotting into the gap 230 between the longitudinal members 228. The two arms 242 sit over the longitudinal members 228 locking the stubs 236 of the rollers 238 into the notches 234. The tabs 244 include lateral protrusions 260 at their lower end, which lock underneath the longitudinal members 228 on either side. This locks the stub rollers 238 into the mat 210 so that they cannot be removed.

The mat 210 includes a plurality of channels 232 defined by walls 226. In the embodiment illustrated, the mat includes six channels creating a mat of approximately 300 mm width. In the embodiment shown in FIG. 12, three mats 210 are joined next to each other to fill the supporting shelf 212. Adjacent mats 210 can be joined together by slotting upwardly extending hooks (not shown) running along one edge underneath the outer wall 226 on the opposite edge of the adjacent mat, similar to that shown in the first aspect of the present invention.

The assembly method for the shelf assembly 200 is quick and easy, as it simply requires the dropping in of the rollers 238 into the channels 232, with a quick brush of a hand over the surface slotting the stubs 236 into the notches 234. Once all of the rollers 238 have been inserted, the lacking members 240 are simply slotted in by pushing them down in between the rollers, locking the tabs 244 into the slots 230, with the lateral protrusions 250 locking underneath the longitudinal members 228.

According to the present invention, a mat could be provided that corresponds to the entire width of the supporting shelf, such that a whole assembly could be placed on a supporting shelf. This assembly also allows for retrofitting to existing shelving, with the mats 210 being placed on top of the shelf and secured with ties. Existing roller systems require specialised shelves and cannot be retrofit.

The invention claimed is:

1. A shelf divider system comprising:

a shelf base defining a support that includes an upper surface configured to receive multiple products thereon, which base has a front and a rear and multiple parallel elongate slots in the base defined by a multiplicity of spaced parallel ribs, which slots extend in a direction from front to rear in multiple sets of at least two aligned slots, the base having a forwardly outstanding integral formation at the front of the shelf base;

an upstanding transversely extending front stop including a lower stop mount, the front stop mounted to the shelf base at said front by releasable engagement of the lower stop mount to the outstanding integral formation, the front stop having an upper edge and a plurality of notches formed in the upper edge, the respective notches associated with said sets of at least two aligned slots; and a plurality of dividers each having a bottom edge with a more rearward rearwardly extending protrusion and a more forward depending tab means having at least one lateral protrusion, and a front edge with an upper forwardly extending protrusion having a downturned or return portion;

whereby each divider is selectively releasably engageable with any of said sets of at least two aligned slots by locating said rearwardly extending protrusion under a rear edge of a rear slot and pivoting the divider downwardly to locate the tab means in a front slot and the forwardly extending protrusion in an associated notch on the front stop firmly locating the front stop between the downturned or return portion and the front edge of the divider and locking the lateral protrusion under an adjacent rail when the divider is pushed down, whereupon the divider is not disengageable except by reversing said pivoting action; and whereby the outstanding integral formation is configured to mount the front stop and permit a number of bases to be joined front to rear, the rear of a forward positioned base joining to the outstanding integral formation at the front of a rear positioned base, with the outstanding integral formation on the forward-most base engaging with the front stop.

2. A shelf divider system according to claim 1 wherein the shelf base is an integral slip mat wherein the multiplicity of spaced parallel ribs are aligned front to rear to provide a slip surface along which products may slide, which ribs define said elongate slots between them.

3. A shelf divider system according to claim 2 wherein said integral slip mat further has plural support beams below said slip surface extending transversely to and being integrally joined to said ribs, whereby to define said multiple sets of at least two aligned slots and wherein said rearwardly extending protrusion of each divider locates under a shoulder of a first support beam of said plural support beams.

4. A shelf divider system according to claim 3 wherein said integral slip mat further includes at least one transversely extending fracture line of reduced thickness segments adjacent respective first support beams of said plural support beams.

5. A shelf divider system according to claim 4 wherein said plurality of dividers includes dividers of different lengths to accommodate different depths of slip mats before and after fracture of the slip mat along the fracture line(s).

6. A shelf divider system according to claim 3 wherein said tab means include at least one slotted tab and said integral slip mat further includes formations on a second support beam of said plural support beams that deepen said slots adjacent the second support beam for firmly seating an at least one slotted tab about the second support beam.

7. A shelf divider system according to claim 6 wherein said integral slip mat further includes at least one transversely extending fracture line of reduced thickness segments adjacent respective first support beams of said plural support beams, and said dividers include dividers of different lengths to accommodate different depths of said slip mat before and after fracture of the slip mat along the or each said fracture line, and wherein said slip mat has plural second support beams to match different slotted tab locations on such dividers of different lengths.

8. A shelf divider system according to claim 2 wherein said upstanding transversely extending front stop is mounted to the slip mat by releasable slidable engagement with the outstanding integral formation at the front of the slip mat.

9. A shelf divider system according to claim 1 wherein each said divider is not slidable in said direction from front to rear or vice-versa when the tab means is located in the front slot and the forwardly extending protrusion is located in its associated notch on the front stop.

10. A shelf divider system according to claim 1 wherein each said divider is a flat panel.

11. A shelf divider system according to claim 1 wherein said rearwardly extending protrusion is of hook shaped form.

12. A shelving system including a shelf divider system therefor according to claim 1.

13. A shelving system according to claim 12 including a shelf that comprises the shelf base of the shelf divider system.

14. A shelving system according to claim 12 including a shelf for receiving the shelf base of the assembly, wherein the shelf base is an integral slip mat having a multiplicity of spaced parallel ribs aligned front to rear to provide a slip surface along which products may slide, which ribs define said elongate slots between them.

15. A shelf divider system according to claim 1, wherein said lateral protrusion is one of two lateral protrusions that engage under ribs on either side of the divider.

16. A shelf divider system according to claim 1, wherein each of the plurality of dividers includes a rear divider edge, the rear divider edge being positioned opposite the front edge of the divider and including an upper rear edge portion and a lower rear edge portion, wherein the upper rear edge portion is positioned forward relative to the lower edge portion for easing insertion of each of the plurality of dividers positioned proximate to a rear wall.

17. A shelf divider system according to claim 1, wherein the outstanding integral formation is positioned lower than the upper surface of the support, such that the outstanding integral formation, the lower stop mount, and the engagement therebetween are lower than the upper surface of the shelf base.

18. A shelf divider system comprising:

a shelf base defining a support for multiple products which base has a front and a rear and multiple parallel elongate slots in the base, which slots extend in a direction from front to rear in multiple sets of at least two aligned slots, the base having an outstanding integral formation at the front of the shelf base;

an upstanding transversely extending front stop mounted to the base at said front by releasable engagement with the outstanding integral formation, the front stop having an upper edge and at or adjacent the upper edge respective seats associated with said sets of at least two aligned slots; and a plurality of dividers each having a bottom edge with a more rearward rearwardly extending protrusion and a more forward depending tab means, and a front edge with an upper forwardly extending protrusion;

whereby each divider is selectively releasably engageable with any of said sets of at least two aligned slots by locating said rearwardly extending protrusion under a rear edge of a rear slot and pivoting the divider downwardly to locate the tab means in a front slot and the forwardly extending protrusion in an associated seat on the front stop, whereupon the divider is not disengageable except by reversing said pivoting action, and wherein the tab means includes a protrusion which locks when the divider is pushed down; and whereby the outstanding integral formation is configured to permit a number of bases to be joined front to rear, the rear of a forward positioned base joining to the outstanding integral formation at the front of a rear positioned base, with the outstanding integral formation on the forward-most base engaging with the front stop, wherein each of the plurality of dividers includes a rear divider edge, the rear divider edge being positioned opposite the front edge of the divider and including an upper rear edge portion and a lower rear edge portion, wherein the upper rear edge portion is positioned forward relative to the lower edge portion for easing insertion of each of the plurality of dividers positioned proximate to a rear wall, and wherein the seats on the upstanding transversely extending front stop comprise respective notches in the upper edge of the front stop.

* * * * *